US011642603B2

(12) United States Patent
Bayon

(10) Patent No.: US 11,642,603 B2
(45) Date of Patent: May 9, 2023

(54) ASSEMBLABLE THREE-DIMENSIONAL STORY AND PICTURE DISPLAY

(71) Applicant: Chris Bayon, Langhorne, PA (US)

(72) Inventor: Chris Bayon, Langhorne, PA (US)

( * ) Notice: Subject to any disclaimer, the term of this patent is extended or adjusted under 35 U.S.C. 154(b) by 6 days.

(21) Appl. No.: 17/358,919

(22) Filed: Jun. 25, 2021

(65) Prior Publication Data

US 2022/0410022 A1 Dec. 29, 2022

(51) Int. Cl.
*A63H 3/16* (2006.01)
*A63H 3/00* (2006.01)
*B42D 15/00* (2006.01)

(52) U.S. Cl.
CPC ..... *A63H 3/16* (2013.01); *A63H 3/003* (2013.01); *B42D 15/00* (2013.01)

(58) Field of Classification Search
CPC ..... A63H 3/16; A63H 3/003; A63H 33/04; A63H 33/046
USPC ..... 446/97, 117
See application file for complete search history.

(56) References Cited

U.S. PATENT DOCUMENTS 998,243 A * 7/1911 Gibson ..... A63H 3/16 446/117
2,475,306 A * 7/1949 Beder ..... A63H 3/16 446/117
2,493,697 A * 1/1950 Raczkowski ..... A63F 9/12 273/156
2,725,234 A * 11/1955 Coble ..... A63F 9/1288 273/157 R
3,779,558 A * 12/1973 Moreau ..... A63F 9/12 273/157 R
4,203,525 A * 5/1980 Okubo ..... A63B 5/12 482/25
4,485,585 A * 12/1984 Shackelford ..... A63F 9/06 434/258
4,509,920 A * 4/1985 Kaufmann ..... G09B 17/00 434/258
4,604,073 A * 8/1986 Livesey ..... A63H 3/50 446/117
4,819,963 A * 4/1989 Wolski ..... B42D 1/00 283/64
4,820,234 A * 4/1989 Isaf ..... A63H 3/16 446/337
4,822,313 A * 4/1989 Yasika ..... A63H 33/06 446/124

(Continued)

*Primary Examiner* — Joseph B Baldori
(74) *Attorney, Agent, or Firm* — The Rapacke Law Group, P.A.

(57) ABSTRACT

An assemblable story and picture display may include a plurality of substrates combinable to resemble an object. The assemblable story and picture display may define an outer profile that may resemble an apple, banana, duck, egg, Christmas tree, or any other relatively simple object. Each of the plurality of substrates may define a portion of the outer profile making up the assemblable story and picture display. Each of the plurality of substrates may include a portion of a story or images wherein the story is conveyed sequentially across the plurality of substrates. The assemblable story and picture display may further include an outer decorative image or layer. The assembled story and picture display may include exterior decorative elements indicating the nature of the story depicted on each of the story or display layers.

18 Claims, 5 Drawing Sheets

(56) References Cited

U.S. PATENT DOCUMENTS 4,909,542 A * 3/1990 Marks ..... A63H 33/38 446/72
5,096,204 A * 3/1992 Lippman ..... A63H 33/38 273/287
5,145,177 A * 9/1992 Wells ..... A63F 9/1288 273/156
5,683,086 A * 11/1997 Druckman ..... A63F 9/08 273/156
5,700,177 A * 12/1997 Lemelson ..... A63F 9/12 273/156
5,785,319 A 7/1998 Frauhinger
5,806,853 A * 9/1998 Druckman ..... A63F 9/08 273/156
5,810,357 A * 9/1998 Brink ..... A63F 9/1288 273/156
5,901,983 A * 5/1999 Bini ..... A63H 33/38 281/38
6,206,427 B1 * 3/2001 Kremer ..... A63H 33/38 283/117
6,224,453 B1 * 5/2001 McKinley, Jr. ..... A63H 33/04 446/117
6,276,684 B1 * 8/2001 Hershkovits ..... A63F 9/1288 273/156
6,364,360 B1 * 4/2002 Kaufman ..... A63H 33/38 281/38
6,422,560 B1 7/2002 Harbaugh
7,566,057 B2 * 7/2009 Mascolo ..... A63F 9/0073 273/153 S
7,914,287 B2 * 3/2011 Nguyen ..... G09B 1/02 434/204
10,889,138 B1 * 1/2021 Fry ..... B42D 1/008
2007/0252376 A1 * 11/2007 Legrand ..... A63H 33/38 281/15.1
2009/0091116 A1 * 4/2009 Legrand ..... B42D 1/003 281/21.1
2009/0152858 A1 * 6/2009 Legrand ..... A63H 33/38 446/431
2010/0032898 A1 2/2010 Gearty
2010/0237600 A1 * 9/2010 Gardi ..... B42D 1/00 281/38

* cited by examiner

ASSEMBLABLE THREE-DIMENSIONAL STORY AND PICTURE DISPLAY

TECHNICAL FIELD

The field to which the disclosure generally relates includes 3-dimensional picture and story display, and in particular, a 3-dimensional display comprising a plurality of sequential pieces displaying portions of pictures or stories.

BACKGROUND

A story and picture display may provide for a plurality of assemblable or stackable pieces which may, when assembled, define a particular assembly profile similar to a known object. Each of the stackable pieces may include sequential picture or story elements contributing to a larger picture or story as a whole.

SUMMARY OF ILLUSTRATIVE VARIATIONS

An assemblable story and picture display may include a plurality of substrates combinable to resemble an object, such as, and apple. Each of the individual substrates may include story or display layers disposed thereon. Each of the story or display layers may include display or story designs which, when viewed or read in sequence, may convey a story or information. The assembled story and picture display may include exterior decorative elements indicating the nature of the story depicted on each of the story or display layers.

The assemblable story and picture display may include at least one means for assembling the various substrates and layers, such as, a through rod, magnets, or surface features in a lock-and-key or complimentary configuration such that a user may assemble the story and picture display correctly to resemble the object which the assemble story and picture display is modeled after.

The assemblable story and picture display may be constructed and arranged to display pictures or a story sequentially from a first substrate having story or pictures displayed thereon to an nth substrate having story or pictures displayed thereon. As an example, a parable may be shown or displayed across multiple substrates where a user may disassemble the story and picture display to reveal the parable across each subsequent substrate.

Other illustrative variations within the scope of the invention will become apparent from the detailed description provided herein. The detailed description and enumerated variations, while disclosing optional variations, are intended for purposes of illustration only and are not intended to limit the scope of the invention.

BRIEF DESCRIPTION OF THE DRAWINGS

Examples of variations within the scope of the invention will become more fully understood from the detailed description and the accompanying drawings, wherein.

DETAILED DESCRIPTION OF ILLUSTRATIVE VARIATIONS

Figure 1:
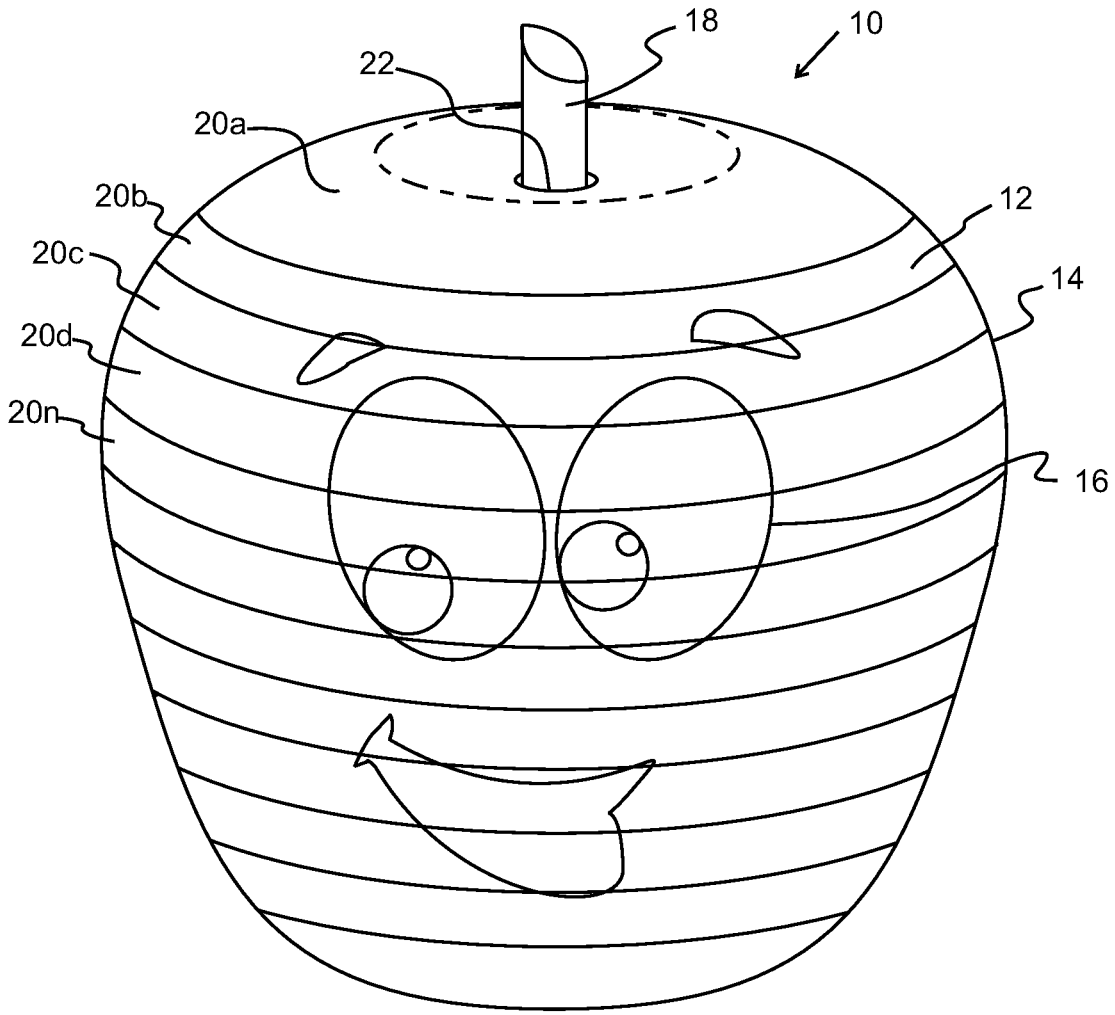
FIG. 1 depicts one variation of an assemblable story and picture display as described herein.

The following description of the variations is merely illustrative in nature and is in no way intended to limit the scope of the invention, its application, or uses. The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and still are within the scope of the invention.

An assemblable story and picture display may include a plurality of substrates combinable to resemble an object such as an apple. The assemblable story and picture display may define an outer profile that may resemble an apple, banana, duck, egg, Christmas tree, or any other relatively simple object. Each of the plurality of substrates may define a portion of the outer profile making up the assemblable story and picture display. The assemblable story and picture display may further include an outer decorative image or layer displaying, as non-limiting examples, a face, text, a design, a color, or the like. The assembled story and picture display may include exterior decorative elements indicating the nature of the story depicted on each of the story or display layers. The assemblable story and picture display may be made up of any suitable material such as, but not limited to, wood, metal, plastic, or the like.

Each of the individual substrates may include a first face opposite a second face. A story or display layer may be disposed on each of the first face and second face. Each of the story or display layers may include display or story designs and which may, when viewed or read in sequence, may depict a sequential story or information. The story or display layers may be printed directly on the first face or second face or may include a prefabricated or pre-printed display layer which may be adhered to the first face or second face. Each display layer may include images or text relevant to a story or puzzle being depicted on the display layers. Display layers may indicate sequential numbers similar to pages of a book such that the assembly order of the individual substrates is more easily understood.

The assemblable story and picture display may include at least one means for assembling the various substrates and layers, such as, a through rod, magnets, or surface features in a lock-and-key or complimentary configuration such that a user may assemble the story and picture display correctly to resemble the object which the assemblable story and picture display is modeled after. As a non-limiting example, the last substrate in the assemblable story and picture display may include a rod extending approximately perpendicular therefrom. Each of the individual substrates may define respective through holes constructed and arranged to allow the rod to pass therethrough, allowing the assemblable story and picture display to be assembled and secured by the rod. As a non-limiting example, each of the individual substrates may include at least one magnet disposed therein such that stacked individual substrates may be attached to one another via magnetic force. The means by which the individual substrates are assembled may include various other methods not explicitly described in this disclosure but which are considered part of the invention.

The assemblable story and picture display may be constructed and arranged to display pictures or a story sequentially from a first substrate having story or pictures displayed thereon to an nth substrate having story or pictures displayed thereon. As an example, a parable may be shown or displayed across multiple substrates where a user may disassemble the story and picture display to reveal the parable across each subsequent substrate.

Referring to FIG. 1, an assemblable story and picture display 10 may include a body 12 including a plurality of individual substrates 20*a*, 20*b*, 20*c*, 20*d*, and 20*n* wherein 20*n* indicates nth individual substrates. The body 12 and nth individual substrates may define an outer profile 14 of the assemblable story and picture display 10. As a non-limiting example, FIG. 1 depicts an assemblable story and picture display 10 roughly approximating the appearance of an apple. The outer profile 14 may resemble an object such as, but not limited to, an apple, duck, banana, pair, cherry, train, baseball, head, hand, or the like. Explicitly disclosed outer profiles in this disclosure should not be considered limiting with respect to the outer profile 14. The assemblable story and picture display 10 may include an outer image 16 printed or disposed on the nth substrates such that, when assembled, the outer image 16 is visible on the body 12. Individual substrate 20*a* may define at least one through hole 22 constructed and arranged to allow a rod 18 to pass therethrough. Each of the nth individual substrates may define respective through holes also constructed and arranged to allow the rod 18 to pass therethrough.

Figure 2:
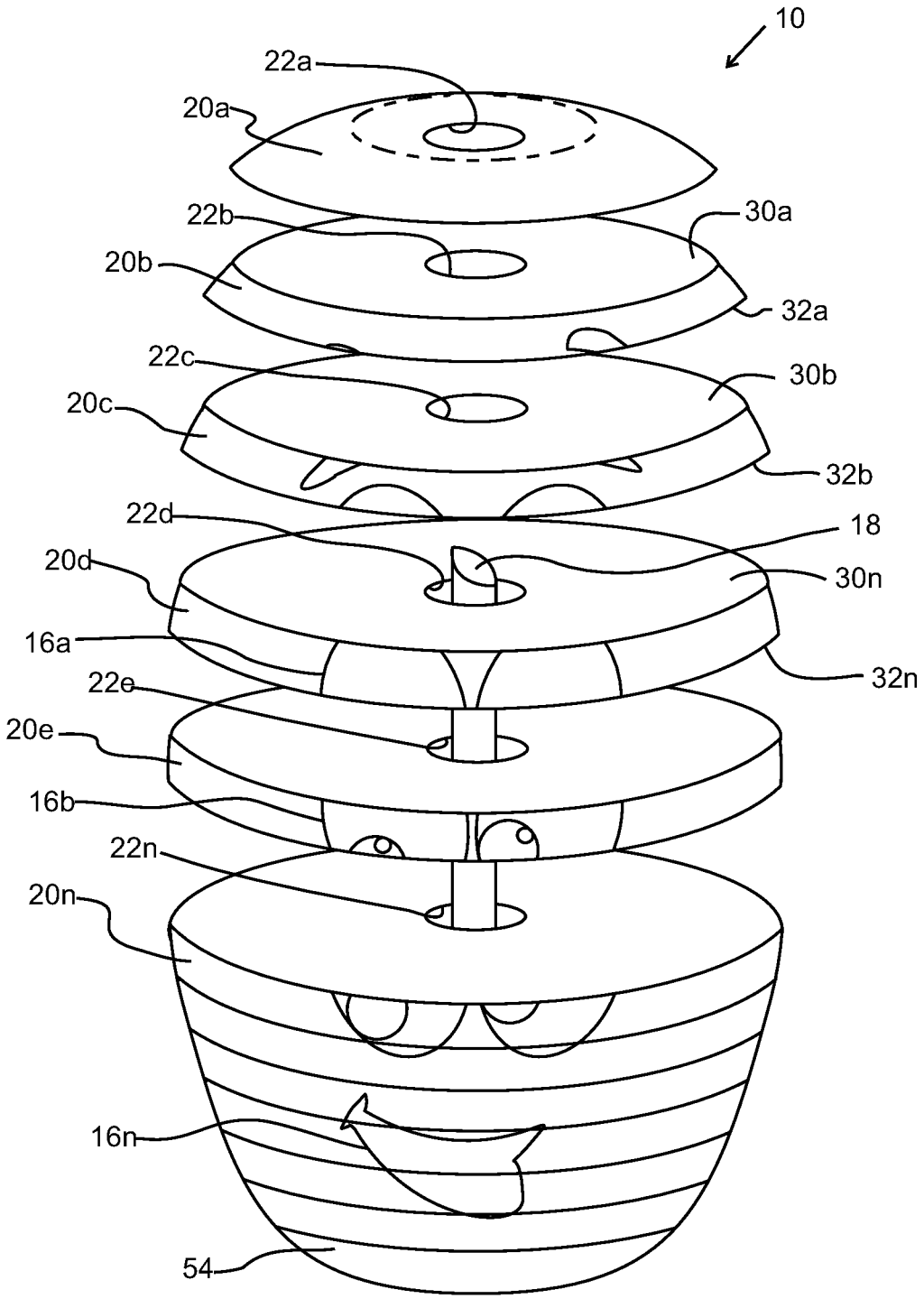
FIG. 2 depicts a partially exploded view of one variation of an assemblable story and picture display as described herein.

FIG. 2 depicts a partially exploded view of an assemblable story and picture display 10 including a first substrate 20*a* defining a first through hole 22*a*. The assemblable story and picture display 10 may include a second substrate 20*b* defining a second through hole 22*b* and having a first face 30*a* opposite a second face 32*b*. The assemblable story and picture display 10 they include a third substrate 20*d* defining a third through whole 22*d* and including a first face 30*c* opposite a second face 32*d*. The assemblable story and picture display 10 may include a fourth substrate 20*d* defining a fourth through hole 22*d* including a first face 30*n* opposite a second face 32*n*. The assemblable story and picture display 10 may include a fifth substrate 20*e* defining a fifth through hole 22*e*. The assemblable story and picture display 10 may include numerous other substrates 20*n* defining through holes 22*n* therein. Portions of the outer image 16*a*, 16*b*, and 16*n* may be printed on or disposed on each of the individual substrates 20*a* through 20*n*. A final substrate 54 may be secured to a rod 18 passing through each of the nth through holes 22*n*.

Figure 3:
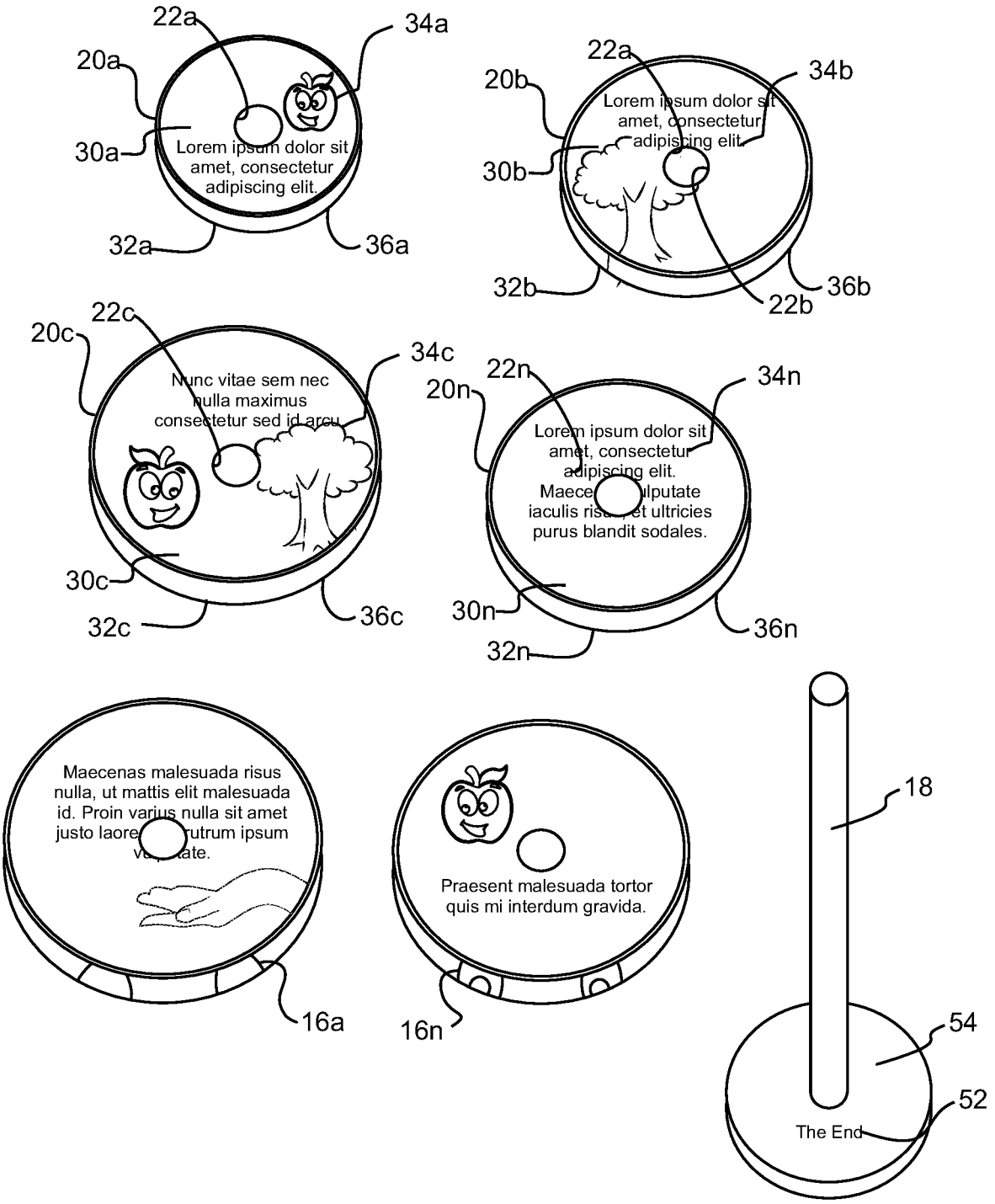
FIG. 3 depicts a disassembled view of the management of an assemblable story and picture display as described herein.

FIG. 3 depicts portions of a disassembled story and picture display including multiple individual substrates 20*a*, 20*b*, 20*c*, and 20*n* defining respective through holes 22*a*, 22*b*, 22*c*, and 22*n*. Layers 30*a*, 30*b*, 30*c*, and 30*n* may be disposed on respective first faces of the individual substrates 20*a*, 20*b*, 20*c*, and 20*n* and may include respective text or images 34*a*, 34*b*, 34*c*, and 34*n*. Layers 32*a*, 32*b*, 32*c*, and 32*n* may be disposed on respective second faces of the individual substrates 20*a*, 20*b*, 20*c*, and 20*n* and may include respective text or images 36*a*, 36*b*, 36*c*, and 36*n*. Text or images 34*a*, 34*b*, 34*c*, and 34*n* and 36*a*, 36*b*, 36*c*, and 36*n* may be sequential such that a story may be shown or displayed. For example, a first portion of story may be depicted on 34*a*, a second portion on 36*a*, a third portion on 34*b*, a fourth portion on 36*b*, a fifth portion on 34*c*, a sixth portion on 36*c*, and so on. Portions of the outer image 16*a* though 16*n* may be printed on or disposed on each of the individual substrates 20*a* through 20*n*. A final image 52 may be printed or disposed on the final substrate 54 indicating the end of the images or stories depicted by the story and picture display.

Figure 4A:
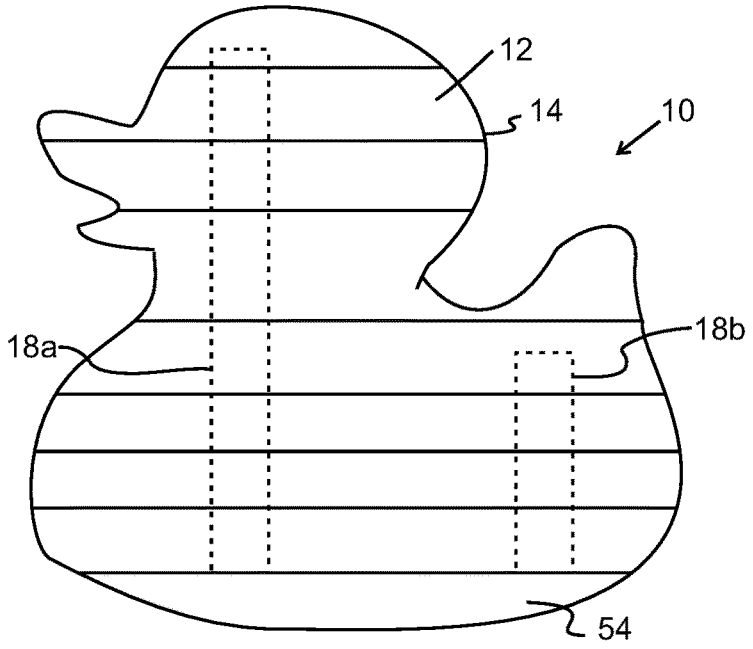
FIGS. 4*a* and 4*b* depict side views of an assemblable story and picture display as described herein.

FIG. 4*a* depicts a cross sectional view of a story and picture display 10 including a body 12 made up of substrates and defining an outer profile 14. The final substrate 54 may be secured to rods 18*a* and 18*b* to allow secure assembly of the story and picture display 10. each of the substrates may define complementary through holes to receive rods 18*a* an 18*b*. While two rods are shown, it should be understood than any number of rods may be implemented in securing the assembly of the story and picture display.

Figure 4B:
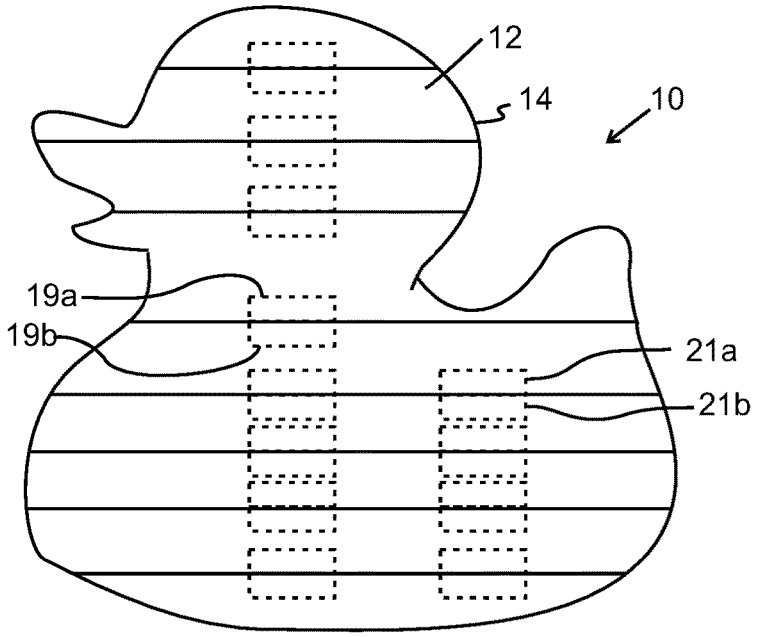

FIG. 4*b* depicts a cross sectional view of a story and picture display 10 including a body 12 made up of substrates and defining an outer profile 14. A first pair of complementary magnets 19*a* and 19*b* may be disposed within a portion of each of the individual substrates and may be constructed and arranged to facilitate the assembly of the story and picture display 10 such that each substrate may be magnetically connected to at least one other individual substrate. Multiple pairs of complementary magnets 21*a* and 21*b* may further facilitate assembly of the story and picture display 10.

Figure 5:
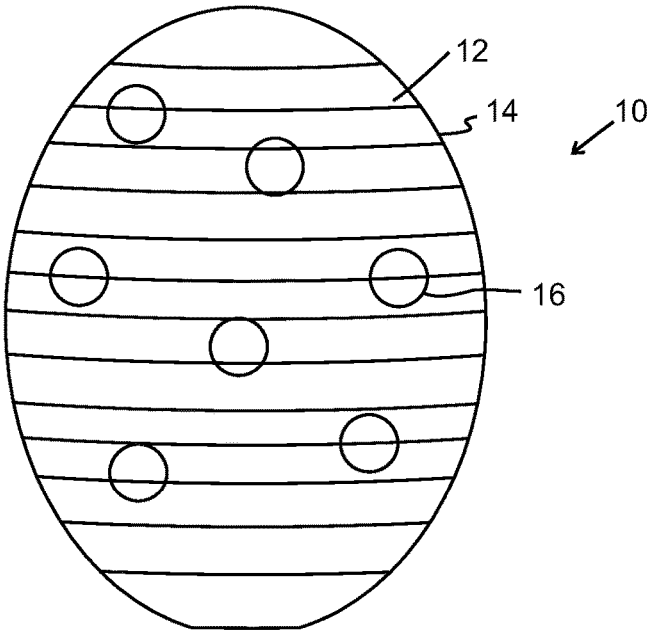
FIG. 5 depicts a variation of an assemblable story and picture display as described herein.
Figure 6:
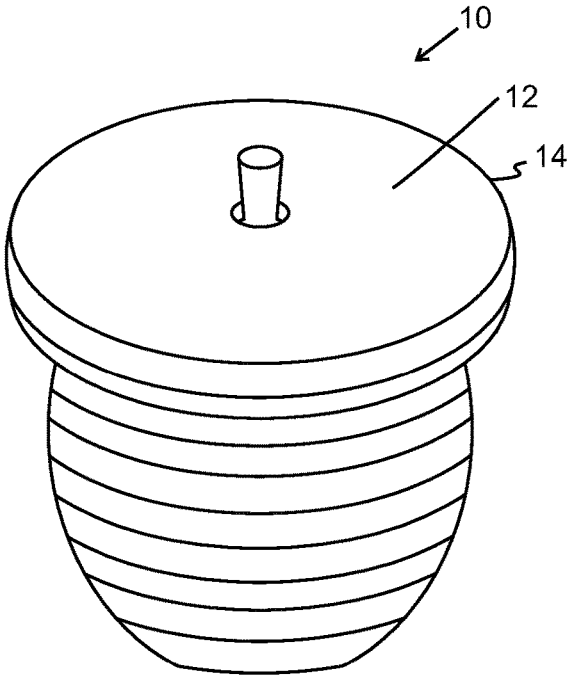
FIG. 6 depicts a variation of an assemblable story and picture display as described herein.

FIGS. 5 and 6 depicts illustrative variations of a story and picture display 10 including a body 12 made of a plurality of substrates and defining an outer profile 14. For example, the outer profile 14 may resemble an egg, acorn, ball, pyramid, animal, or any other object. Outer image 16 may further facilitate the resemblance of the story and picture display 10 to a familiar object.

The present invention includes the description, examples, variations, and drawings disclosed; but it is not limited to such description, examples, variations, or drawings. As briefly described above, the reader should assume that features of one disclosed variation can also be applied to all other disclosed variations, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other variations will be apparent to a person of ordinary skill in the packaging arts, and all such modifications and other variations are intended and deemed to be within the scope of the present invention.

What is claimed is:

1. An assemblable story and picture display comprising:

a body comprising a plurality of individual substrates defining an outer profile, the substrates being independent of one another;

each individual substrate having a first face opposite a second face, at least one through hole defined by the individual substrate, and an outer edge, each outer edge contributing to defining the outer profile;

a plurality of decorative images disposed on the first face and the second face of each individual substrate, the plurality of decorative images conveying at least one of sequential story images or story text;

a cylindrical rod having a slanted face first end opposite a second end, the cylindrical rod being constructed and arranged to receive each of the individual substrates by passing the rod over the slanted face first end through each of the at least one through holes; and wherein the outer profile resembles at least one of sequential story images or story text depicted on each of the plurality of decorative images.

2. An assemblable story and picture display as in claim 1, wherein the plurality of decorative images are adhered directly to the first face and second face.

3. An assemblable story and picture display as in claim 1, further comprising:

a plurality of decorative layers disposed on each first face and second face, the plurality of decorative images being disposed on the plurality of decorative layers.

4. An assemblable story and picture display as in claim 3, wherein the plurality of decorative layers are secured to the first face and second face by an adhesive.

5. An assemblable story and picture display as in claim 1, further comprising an outer decorative image on the body and plurality of individual substrates.

6. An assemblable story and picture display as in claim 1, wherein the outer profile resembles a fruit.

7. An assemblable story and picture display as in claim 1, wherein the outer profile resembles an animal.

8. An assemblable story and picture display as in claim 1, wherein the outer profile resembles a plant.

9. An assemblable story and picture display comprising:

a body comprising a plurality of individual substrates defining an outer three-dimensional profile of the body, the substrates being unbound to one another;

each individual substrate having a first face opposite a second face and an outer edge, at least one through hole defined by the individual substrate, each outer edge contributing to defining the outer profile;

a plurality of decorative layers disposed on the first face and the second face of each individual substrate, wherein each of the plurality of decorative layers comprises a decorative image thereon;

a cylindrical rod having a slanted face first end opposite a second end, the cylindrical rod being constructed and arranged to receive each of the individual substrates by passing the rod through each of the at least one through holes;

a plurality of individual magnets, each of the plurality of individual magnets disposed within the plurality of individual substrates such that the plurality of individual substrates may be secured to one another via magnetic force; and wherein the plurality of decorative images are sequential and are constructed and arranged to convey a story.

10. An assemblable story and picture display as in claim 9, wherein the plurality of decorative images are adhered directly to the first face and second face.

11. An assemblable story and picture display as in claim 9, further comprising:

a plurality of decorative layers disposed on each first face and second face, the plurality of decorative images being disposed on the plurality of decorative layers.

12. An assemblable story and picture display as in claim 11, wherein the plurality of decorative layers are secured to the first face and second face by an adhesive.

13. An assemblable story and picture display as in claim 9, further comprising an outer decorative image on the body and plurality of individual substrates.

14. An assemblable story and picture display as in claim 9, wherein the outer profile resembles a fruit.

15. An assemblable story and picture display as in claim 9, wherein the outer profile resembles an animal.

16. An assemblable story and picture display as in claim 9, wherein the outer profile resembles a plant.

17. An assemblable story and picture display comprising:

a body comprising a plurality of individual substrates defining an outer profile;

each individual substrate having a first face opposite a second face, at least one through hole defined by the individual substrate, and an outer edge, each outer edge contributing to defining the outer profile;

an outer decorative image on the body and plurality of individual substrates;

a plurality of decorative layers disposed on each first face and second face;

a plurality of decorative images disposed on the plurality of decorative layers of each individual substrate wherein the plurality of decorative images are sequential and are constructed and arranged to convey a story; and at least one cylindrical having a slanted face first end opposite a second end, the second end being secured approximately perpendicular to a last individual substrate, the at least one rod being constructed and arranged to receive each of the individual substrates by passing the at least one rod through each of the at least one through holes.

18. An assemblable story and picture display as in claim 17, wherein the plurality of decorative layers are secured to the first face and second face by an adhesive.

* * * * *